US009058730B2

(12) United States Patent
Mullins et al.

(10) Patent No.: US 9,058,730 B2
(45) Date of Patent: Jun. 16, 2015

(54) INTRUDER DETERRENT SYSTEM

(75) Inventors: Robert Clive Mullins, Thames Ditton (GB); Duncan Edward Willis, Harston (GB); Denis Skvortsov, Horningsea (GB)

(73) Assignee: Applied Concepts Limited, Harston, Cambridge (GB)

( * ) Notice: Subject to any disclaimer, the term of this patent is extended or adjusted under 35 U.S.C. 154(b) by 142 days.

(21) Appl. No.: 13/516,928

(22) PCT Filed: Dec. 16, 2010

(86) PCT No.: PCT/GB2010/052102

§ 371 (c)(1),
(2), (4) Date: Sep. 19, 2012

(87) PCT Pub. No.: WO2011/073661

PCT Pub. Date: Jun. 23, 2011

(65) Prior Publication Data

US 2013/0106605 A1 May 2, 2013

(30) Foreign Application Priority Data

Dec. 18, 2009 (GB) ..... 0922141.7

(51) Int. Cl.

| | |
|---|---|
| ***G08B 15/00*** | (2006.01) |
| *G08B 5/38* | (2006.01) |
| *G08B 25/00* | (2006.01) |
| *G08B 27/00* | (2006.01) |

(52) U.S. Cl.

CPC *G08B 15/00* (2013.01); *G08B 5/38* (2013.01); *G08B 25/009* (2013.01); *G08B 27/003* (2013.01)

(58) Field of Classification Search

USPC ..... 340/541, 550, 545.3, 552, 539.12; 348/143, 152

See application file for complete search history.

(56) References Cited

U.S. PATENT DOCUMENTS

| | | | | |
|---|---|---|---|---|
| 5,463,595 | A | 10/1995 | Rodhall et al. | |
| 6,078,269 | A | 6/2000 | Markwell et al. | |
| 6,118,375 | A | 9/2000 | Duncan | |
| 6,819,239 | B2 * | 11/2004 | Bingham | 340/541 |
| 7,154,391 | B2 * | 12/2006 | Maki et al. | 340/550 |
| 7,458,321 | B2 * | 12/2008 | Bornstein et al. | 102/401 |

(Continued)

FOREIGN PATENT DOCUMENTS

| | | |
|---|---|---|
| DE | 32 46 906 A1 | 6/1984 |
| GB | 2 162 352 A | 1/1986 |

(Continued)

OTHER PUBLICATIONS

International Search Report for corresponding PCT/GB2010/052102, completed Mar. 7, 2011 by de la Cruz, Valera D. of the EPO.

(Continued)

*Primary Examiner* — Jennifer Mehmood
*Assistant Examiner* — Omar Casillashernandez
(74) *Attorney, Agent, or Firm* — Tarolli, Sundheim, Covell & Tummino LLP

(57) ABSTRACT

This invention relates to portable area denial systems and to related methods. We describe an intruder deterrent system, the system comprising a plurality of nodes, each said node having a strobe light, and at least one of said nodes having an intruder-detecting sensor, wherein the system is configured to flash at least one of said strobe lights on detection of an intruder by said sensor to deter said intruder.

21 Claims, 4 Drawing Sheets

(56) References Cited

U.S. PATENT DOCUMENTS

| | | | | |
|---|---|---|---|---|
| 7,633,067 | B2 * | 12/2009 | Ikeda | 250/353 |
| 7,966,660 | B2 * | 6/2011 | Yermal et al. | 726/22 |
| 8,302,901 | B2 * | 11/2012 | Hatton et al. | 244/12.2 |
| 2007/0252720 | A1 | 11/2007 | Hughes et al. | |
| 2009/0180280 | A1 | 7/2009 | Hadden | |
| 2009/0257373 | A1 * | 10/2009 | Bejerano | 370/328 |
| 2009/0289790 | A1 * | 11/2009 | Issokson | 340/552 |

FOREIGN PATENT DOCUMENTS

| | | | |
|---|---|---|---|
| GB | 2 184 277 | A | 6/1987 |
| GB | 2 282 475 | A | 4/1995 |
| GB | 2 326 008 | A | 12/1998 |
| JP | 2006227970 | A | 8/2006 |
| WO | WO 2004/036342 | A2 | 4/2004 |
| WO | WO 2007/011852 | A2 | 1/2007 |
| WO | WO 2008/105187 | A1 | 9/2008 |
| WO | WO 2010/104594 | A2 | 9/2010 |

OTHER PUBLICATIONS

British Search Report for corresponding GB 0922141.7, completed Mar. 25, 2011 by Richard Kerslake of the UKIPO.

* cited by examiner

Two lights operating together causing excessive voltage drop

Two lights operating sequentially to avoid excessive voltage drop

INTRUDER DETERRENT SYSTEM

RELATED APPLICATIONS

The present application is a U.S. 371 National Phase filing claiming priority from PCT/GB2010/052102 filed 16 Dec. 2010, which claims priority from GB 0922141.7, filed 18 Dec. 2009, which are incorporated herein in their entirety.

FIELD OF THE INVENTION

This invention relates to portable area denial systems and to related methods.

BACKGROUND TO THE INVENTION

There often exists a requirement to secure an area against unauthorised personnel, particularly at night when they are able to move by stealth. Where the use of physical barriers or manned protection is impractical, other means of denying the area are required. One such possible method is to make unauthorised personnel feel uncomfortable and visible to others. This is termed a denial method.

One such method is the use of motion detection to activate lighting, which is commonplace in prior art. Such lighting is often used to deter intruders because it highlights their unauthorised presence to others, who might then challenge them or report them to security personnel. However the light is designed for illumination and not for disruption, and such methods turn on the light for typically many seconds or minutes, and therefore require a significant amount of energy, which cannot be supplied from small batteries. For this reason, and also because they are typically used outside, such systems should usually be wired to a mains supply, which requires skilled personnel to install. Such a system therefore cannot readily be deployed at short notice by unskilled personnel, or in areas where mains power is not available.

A further deficiency of this prior art is that each unit can only cover a small area, that which is within sensor range. Consequently, if a large area is to be covered, multiple units should be deployed, necessitating that each unit be small and lightweight.

It may also be required to deploy such devices covertly so that they cannot easily be found and disabled. This is another reason that they should be small.

Whilst it is possible to argue the definitions of "small" and "portable" in the context of this method, it can be seen that the limiting factor in making devices small and highly portable, is the energy required by a powerful light source that should be powered for at least several seconds, therefore requiring a battery or energy store of high storage capacity.

It is often necessary for a system to distinguish between authorised and non authorised personnel, so that authorised personnel may enter and leave the area at will without triggering the denial method. Such systems that exist in the prior art are "dumb". That is to say, they simply turn on the light when any presence is detected, and do not distinguish between authorised and non-authorised personnel.

Background prior art is found in: Multi-action battery powered trigger activated lighting system US20090180280.

SUMMARY OF THE INVENTION

In a first aspect the invention provides an intruder deterrent system, the system comprising at least one node, and at least one strobe light, at least one of said nodes having an intruder-detecting sensor, wherein the system is configured to flash said at least one strobe light on detection of an intruder by said sensor to deter said intruder.

Further aspects of the invention are set out in the claims, and are also defined below:

An apparatus to deter access by unauthorised personnel to an area under protection is comprised of one or more portable nodes where any node may either be equipped with one or more sensors capable of detecting human or vehicular presence, or any node may be equipped with one or more high-intensity lights which emit one or more short intense bursts of light, or any node may be equipped with both sensors and lights, and operating such that one or more nodes' lights are fired when a sensor detects a human or vehicular presence in the area and dependent on the ambient light level if so configured, the intense bursts of light being designed to disorient an intruder and to betray his presence to users when such an intruder is detected but not to cause permanent damage to eyesight.

An apparatus, whereby one or more nodes optionally communicate by means of a wireless network to each other if applicable, and to an optional central control and display unit and thereby cause the presence of an intruder to be communicated to a user in the form of an alarm and a notification of the sensor node that triggered, or so that an alarm signal from another source or a panic button may cause the light emitting nodes to activate, and that a trigger on any one sensor node may cause a plurality of nodes to fire, the decision of each node to fire being dependent on system configuration and optionally on their relative spatial distance from the original triggering sensor.

An apparatus where a system comprising more than one node, the nodes coordinate their strobe firing patterns among each other by means of the wireless communication network, in an irregular, or rapid, or fast-changing or moving pattern, with the intention to cause maximum disorientation in an intruder.

An apparatus that can optionally be controlled from a controller by means of a wireless communication link in order that it can be turned on or off at will or automatically by means of a control unit that emits periodic control signals and is carried by an authorised user, thereby allowing friendly personnel to pass, and/or to be configured to set operating parameters such as detection range, strobe flash pattern and duration, and other parameters, and/or to convey to the user the status of the system such as whether any nodes have been triggered, and system information such as battery condition of the nodes.

The wireless communication link may comprise a multi-channel link (for example time and/or frequency multiplexed) or a plurality of separate channels may be employed for communicating with the different nodes; spread spectrum techniques may be employed. Radio frequency or infrared communication may be employed.

An apparatus containing one or more nodes each of which uses very low power so that it can be powered from small non-rechargeable (primary) battery power, or ambient energy that is captured by a node using solar cells or thermal generators or other means of converting ambient energy sources into electricity, and the electric power being stored in the node by means of rechargeable battery storage or capacitor storage or other means of electrical energy storage.

An apparatus that by virtue of it requiring low energy to operate and therefore being possible to make into a small size and independent of mains power may be covertly deployed, camouflaged, or hidden inside other objects, or easily disguised, or be able to be deployed rapidly by unskilled personnel, or dropped in place from a height or fired by ballistic means, so that a plurality of them can rapidly be deployed in order to protect a wide area.

A further method of a deployment assistance mode to ensure complete coverage of area, where a control computer is aware of the location of each node and can calculate such missing areas of coverage where such missing areas of coverage can be indicated to the user as he is deploying further units by means of firing lights or beacons. The control computer may be aware of the location of each node, for example, because a user has entered this information manually, for example on a map-type graphical user interface, or RF location techniques may be employed to detect the location of the nodes, or (less preferably) a node may include a location determining system such as differential GPS.

An apparatus where a node may operate in beacon mode, whereby each node optionally can be set to generate pulses of light in the visible spectrum, which may be used to alert potential intruders that the area is protected, or may be used by users to check for correct operational status, locate nodes for deployment assistance, gathering of units when they are no longer needed, or to demarcate an area on user request.

An apparatus where a node may be equipped with an optional infra-red beacon outside the visible spectrum which is activated for a certain length of time following a triggering event, it being visible to users equipped with infra-red viewing equipment but not visible to the intruder, it being used to locate nodes in the dark or covertly to identify, or briefly illuminate, an area where the sensor has indicated movement.

An apparatus with a node having a optional output signal to synchronise a camera to capture a photograph during a burst of light.

A further method of a node emitting light in the infra-red spectrum to illuminate the intruder in the infra-red spectrum so he is unaware of it but so that he can be identified by those equipped with infra-red viewing equipment, and optionally be photographed by an or infra-red camera synchronised to the burst of light, described in a related claim.

An apparatus where a node which contains more than one light emitting devices may fire them in a sequence such that the maximum current draw at any point in time does not cause an excessive power supply voltage drop which could lead to operational failure.

An apparatus with nodes containing an optional means of tamper detection by vibration or opening of the node, and to disabling of the node upon such tamper.

A method by which a node containing more than one light emitting device, in order to cover different angles or to increase the overall light intensity, or for a combination of those reasons, that the light emitting devices are illuminated in a sequence and not all on at once, so that that the peak current drain is limited to that which the power supply is capable of supplying while at all times providing sufficient power for correct operation of the node.

A mechanical arrangement of the sensor and or lamp components on a circuit board shaped in such a way as to have such sensors and lights facing outward in a sweep of up to 360 degrees outlook and optionally to be angled upwards in order to give optional range when the node is situated at or near ground level, and with such circuit board and components to be positioned around the battery or energy storage device for optimal use of space, and where lights be selectively enabled or disabled according to the direction the motion was detected.

An possible embodiment where the shape and weight of the node is so configured as to make the node self-righting in position at the time of deployment, or if subsequently disturbed.

In a related aspect the invention provides an intruder detection deterrent system comprising a set of intruder detection nodes, each said node comprising a physical housing for deployment by placing on the ground, a battery powered microprocessor, wireless communications system for communicating with other nodes and/or a base station, and an alerting system for providing an overt or covert alert, such that the nodes of the system are deployable by dispersing over an area of ground to protect said area of ground from intruders.

In a further related aspect the invention provides a method of protecting an area of ground from intruders, the method comprising: providing a system as described above; deploying a plurality of said nodes over the surface of said area of ground such that said nodes are in wireless communication with one another and/or a base station; detecting an overt or covert alert from one or more of said nodes to detect a potential said intruder.

In some preferred embodiments the nodes are networked with each other and a base station by wireless communication which may comprise rf or infra-red communication. Preferably each node has an alarm, in particular a strobe light (which has the advantage of drawing a low battery current), but optionally also an infra-red alert and/or an rf message alert to the base station. In some preferred embodiments one node triggers one or more neighbouring nodes to also provide an alert and/or to wake up into an operational node and/or to share information to provide enhanced intruder detection. In embodiments detection of an intruder by more than one node may be required to confirm detection, to reduce false alarms.

To provide an 'electronic minefield' to protect a region of ground from, for example, from covert placement of an explosive device, the system may provide a covert alert in the form of an IR strobe from a node and/or physical tagging of a detected intruder (and/or the ground) for later identification. The latter may be performed by spraying the intruder with a fluorescent material, for example a nanodot fluorescent material. This may be configured to fluoresce outside the visible spectrum and/or when illuminated with a wavelength outside the visible spectrum (which may be defined as 400 nm-750 nm). Optionally a spray of fluorescent material may comprise a plurality of different colours to encode the spray with data by choice of colours, for example to carry additional information relating to the intruder detection event.

In such a covert approach when, say, an intruder has been (covertly) detected at night the ground may be checked in the morning to determine whether or not the intruder was benign.

In embodiments a node may include an acoustic sensor such as a small microphone, accelerometer, or other vibration sensor. Preferably then the processor in a node (which may be a general purpose microprocessor, a digital signal processor, and/or may comprise dedicated hardware) has an input from the acoustic sensor (for example via an analogue-to-digital converter) and is configured to selectively detect an acoustic signal indicative of digging or similar ground disturbance or alteration. Thus a node may be configured to differentiate between, say, digging and a vehicle driving over the ground; this may be achieved with selective filtering and/or the spectrum analysis techniques, for example looking for energy at a characteristic frequency or range or pattern of frequencies. In embodiments detection of such an acoustic signal is recorded locally and/or remotely (for example at a base station).

In embodiments the system may be provided with a portable control unit which may be carried or worn to disable or inhibit the system to enable a friendly user to walk through the protected area without triggering an alert.

Where a node has an overt alert, this may include a lifting system to lift the node off the ground on detection of an intruder. In a preferred approach this may comprise a motor driven fan, optionally with folding-flat blades, to direct air downwards over a curved or domed physical surface of the node to provide lift via the coanda effect. Thus in embodiments, when an intruder is detected a node may lift off the ground and/or flash a strobe light. In embodiments a node is provided with a tamper detect/protect system which may, for example, wipe non-volatile program and/or data memory of a node on detection of attempted tamper.

In some preferred implementations of the system the base station is able to detect the location of the nodes to identify potential gaps in coverage. This may be done, for example, by rf location techniques where the nodes are coupled in a wireless network—either separate antennas may be employed for triangulation or the nodes themselves may, for example, perform triangulation to identify the locations of other nodes.

In embodiments nodes may be deployed by ballistically projecting the nodes over a range or region of spatially distributed locations.

The above described aspects and embodiments of the system may be employed separately and in this specification independent protection may be sought for the above described features of the nodes/system, taken separately.

BRIEF DESCRIPTION OF THE DRAWINGS

These and other aspects of the invention will now be further described, by way of example only, with reference to the accompanying figures in which.

DETAILED DESCRIPTION OF PREFERRED EMBODIMENTS

Figure 1:
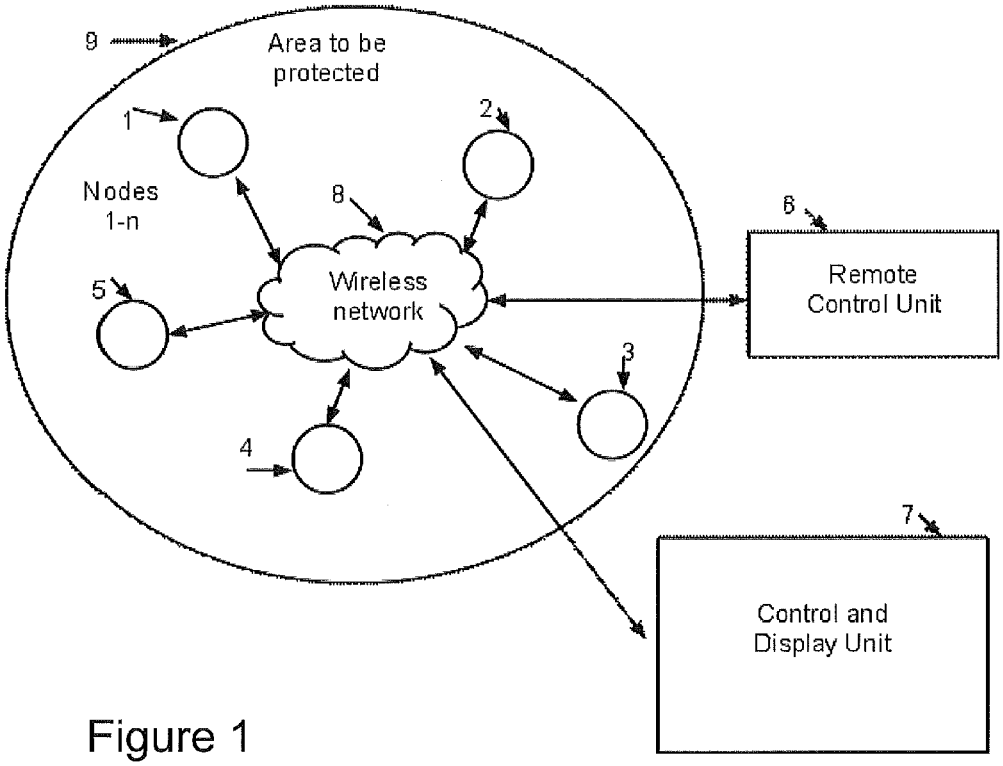
FIG. 1 illustrates one example overall layout of a system comprised of one of more nodes and the optional control units.

We will describe an area denial method that is portable and an apparatus for carrying out the method.

Embodiments make possible a small, easily deployable and highly portable area denial method, by overcoming the limitation of the energy requirement of a conventional illumination system, by using a lamp that emits one or more short, intense bursts of light ("strobe lights") designed to surprise, deter and disorientate the intruder as well as highlighting his presence to others, although not to cause permanent damage to eyesight. Such short bursts of light use significantly less energy and can be generated from high efficiency light emitting sources using very small batteries, and would have a duration typically, but not necessarily limited to, under one second. By constraining the duration of the light emission, the peak current flow through the emitter can be much higher than could be sustained even for a few seconds, allowing a very high brightness flash to be generated. Such peak current can be obtained by the discharge of a capacitor that has previously been charged at much lower current but over a longer time—this technique may be used to generate very high brightness flashes.

In a preferred embodiment the apparatus comprises one or more portable battery powered devices ("nodes"), distributed around the area to be protected, each node being equipped with a control processor, one or more optional intruder sensors capable of detecting human presence and, one or more optional lamps capable of producing one or more short, brilliant bursts of light ("strobe lights") which are activated under the control of the control processor. For the avoidance of doubt, nodes may contain either one or more sensors, or one or more lights, or any combination of such sensors and lights.

An intruder moving in the area to be protected, will cause one or more sensors to be activated, which under the selective control of the control processor, can thereby cause one or more brilliant bursts of light to be generated around him, thereby engendering in him a sense of surprise and confusion, a sense that he has been detected and that his presence has been betrayed, and to alert the user of the presence of an intruder in the vicinity. Such confusion in the intruder will disrupt his malevolent intent and may deter him from further action. Optionally, an alarm will be generated at a remote alarm display unit, alerting the user of the intruder and the sensor which detected him.

In a preferred embodiment any node may optionally contain a wireless transceiver allowing the node to be controlled at distance by means of a controller equipped with a matching wireless transceiver, and, optionally, for multiple nodes to interact in a network, thereby optionally sending detection events to a central alarm display unit, and allowing the collection of nodes to be remotely controlled by the user, and so that multiple nodes may be triggered in a widespread pattern across the network to further confuse the intruder. Such a wireless control method allows the system to be controlled by an authorised user carrying a remote control, thereby allowing him to pass without triggering the system, such a method could be automatic, in that the said remote control could emit a periodic signal thereby indicating to the system that an authorised user is within its area.

An optional ambient light sensor may disable the lights during daylight, whereas the sensors can remain active at all times.

The type of sensor used to detect intruder presence may be of the sort in, but not limited to, prior art, for example Passive Infra-Red (PIR), magnetic proximity, microwave radar, ultra-wide-band proximity detection.

A preferred light source is a light emitting diode, which has a high efficiency in converting electrical power to light, and is small and inexpensive. Another means of achieving a high brightness light is by means of discharging a current through a gas which is typically xenon. Either means is possible in embodiments of the invention. It is not important what the colour the light is, so long as it achieves a high brightness effect. One possible embodiment is that the strobe light is in the invisible infra-red spectrum, which would cause the intruder to be illuminated for the purposes of infra-red camera or other infra-red viewing equipped devices to capture his image, but that the intruder does not even notice that the flash has fired.

A further enhancement to the system is that a node may be equipped with an optional infra-red beacon outside the visible spectrum which is activated for a certain length of time following a triggering event, it being visible to users equipped with infra-red viewing equipment but not visible to the intruder, it being used to locate nodes in the dark or covertly to identify an area where the sensor has indicated movement. In addition the strobe light itself can be used in beacon mode, whereby each node optionally can be set to generate pulses of light in the visible spectrum, which may be used to alert potential intruders that the area is protected, or may be used by users to check for correct operational status, locate nodes for deployment assistance, gathering of units when they are no longer needed, or temporarily to demarcate an area on user request.

In the example below the energy consumption difference between a steady motion detected lighting units and a strobe flash according to an embodiment of the invention, is illustrated. (In each case, the standby power, which powers the detector when the light is not on, is ignored).

1. Energy consumed by typical motion detected light:
Light power (typical) 250 W
On-time duration (typical) 30 s
Energy usage per activation=250 W×30 s=7.5 kJ
2. Energy consumed by an embodiment of the invention when the flash is fired.
Light power (typical, light emitting diode) 4 W
On-time duration (typical 4 flashes at 100 ms each) 400 ms
Energy usage per activation=4 W×400 ms=1.6 J There is approximately 4600 times difference in the relative energy usage between the two scenarios. By way of illustration, a small 9V battery (for example an alkaline "PP3", with a claimed capacity of 500 mAH at 9V) has an energy content of about 16 kJ, which would have only enough energy to fire a standard light twice, even if the false assumption that it could sustain the instantaneous power drain required to do so, is made whereas such a small battery could power a system of the type we describe ten thousand times.

By way of further illustration, consider a high density "super capacitor" which is commercially available. A 1F capacitor charged to 3V has an energy content of $0.5\times1F\times(3V)^2=4.5$ J. This could power a system of the type we describe up to three times before being recharged, and such a capacitor may be trickle charged from an ambient source such as solar energy or thermal difference, or from a tiny primary cell that by itself would be incapable of supplying sufficient instantaneous power to supply the strobe light.

We describe a method by which the peak current drawn by the lights (when a node has more than one) can be limited by sequencing the firing of the lights, in order to prevent voltage drop on the power supply causing system failure if the supply voltage falls below its minimum requirement.

It is possible that an unauthorised person might obtain a node and attempt to use it for malevolent purposes for example to attempt to make an unauthorised connection into the network or to use it himself. The node may optionally contain a tamper detector which typically would be a movement detector such as a mechanical trembler switch or accelerometer. Once deployed, the node would begin operation once commanded by the user to do so. In the case of tamper detection, typically when motion of the node itself is detected or its case is opened, or a sudden and unexpected change in the ambient light level, the node would erase the information such as its operating firmware or security keys that it needs to gain access onto the wireless network and render itself completely inoperable.

Detailed Example

The apparatus shown in FIG. 1 indicates a possible system layout of several sensor-emitter nodes (1 to 5) where the number of nodes can be one or more, where in this case five are drawn for example, a central control and display unit 6, an optional remote control 7, with wireless communication links into a network 8 and deployed about the area to be protected 9.

Figure 2:
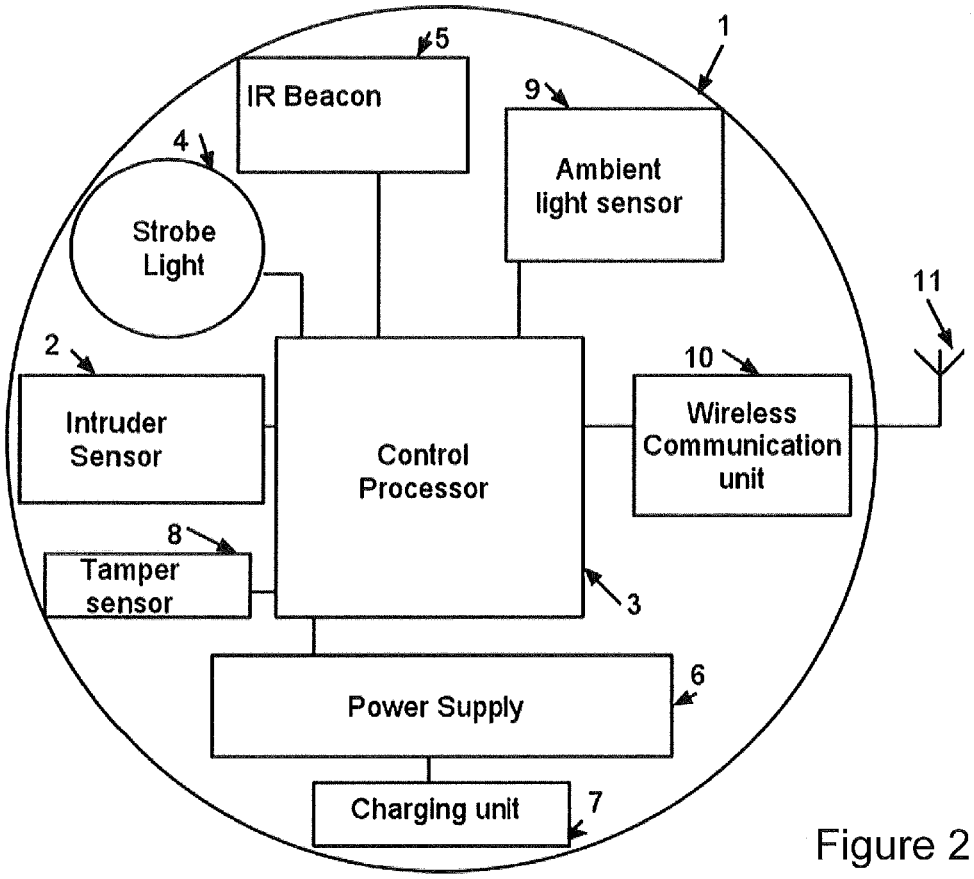
FIG. 2 illustrates an example a node design.

The conceptual arrangement of the sensor-emitter node is shown in FIG. 2. A sensor and/or emitter node 1, comprises an optional sensor 2 capable of detecting human or vehicular presence, a control processor 3, an optional light emitting device 4, an optional infra red beacon light emitting device 5, a power supply 6, an optional means of charging the power source (if charging is possible) 7, an optional tamper sensor 8, an ambient light level sensor 9, a wireless communications unit 10 and antenna 11. It should be noted for the avoidance of doubt that a node may contain either a sensor, an emitter, or both. In certain applications it may be required to separate the sensing nodes from the light strobe emitting nodes, or to control the strobe lights via external control, for example from an existing alarm system.

In addition it should also be noted that a node my be equipped with more than one sensor, with the intention of increasing range or coverage angle, and for the same reasons, more than one strobe light. In addition it may be envisaged that a given sensor covers a particular angle of outlook and that there is an associated strobe light covering that angle, and that it is only necessary to fire the strobe light associated with the sensor that triggered.

Figure 3:
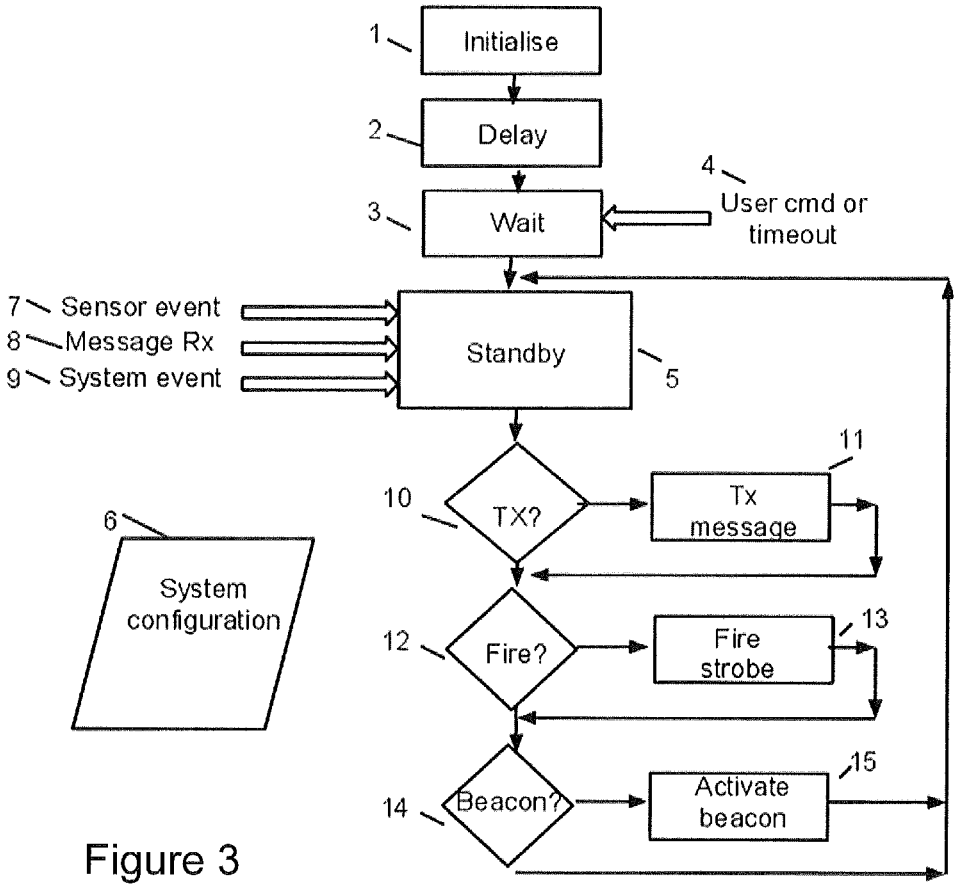
FIG. 3 shows a flow diagram illustrating an example procedure implemented in operation of a node.

A flowchart indicating the overall program flow of the control processor is shown in FIG. 3. On power up, an initialisation stage 1 sets up the node for operation and connects the device to the wireless network. Node configuration and system status is stored in a data structure 6. A delay stage 2 allows the sensor, if present, to stabilise. The node then enters a wait state 3. On an explicit user command to start operation 4, or automatically after a predetermined time allowed for the user to leave the scene following deployment, the node enters standby state 5 where it is ready to process sensor and communication events as they occur.

In standby state 5, the node enters a low-power mode awaiting events from the intruder sensor 7, or from communication from other devices in the apparatus 8 or periodic system monitoring events 9. On such events being received an activity is started, the type of activity dependent on the configuration of the node and the type of event received.

The periodic system monitoring event 9, causes system status such as an indication to the user that the unit is in correct operating order and that the communications link is alive, that battery (or stored power) level is adequate, or tamper detection has occurred, to be communicated over the communication link.

A decision algorithm 10 based on the node configuration optionally sends the event to the wireless communications unit 11 so that it may transmitted and be acted upon by other devices that are part of the apparatus, such as other nodes or a control and display unit.

A decision algorithm 12 based on the node configuration and system status (dependent on the magnitude of the intruder sensor signal, the ambient light level and the system status) is evaluated, and if the decision evaluates true, the light is fired to a predetermined pattern contained in the node configuration by means of the fire pattern generator function 13.

A decision algorithm 14 based on the node configuration optionally activates the optional beacon emitting lights 15.

Following completion of the event-generated activity, the control flow returns to the standby state 5.

Figure 4:
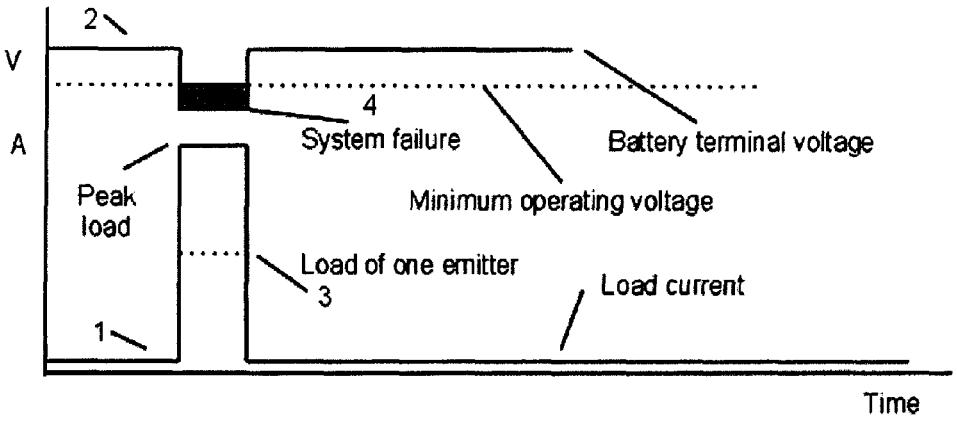
FIG. 4 illustrates peak current draw during multiple lamp operation, causing supply voltage drop, leading to operational failure.

An illustration indicating the current flow for the light emitting devices is shown in FIG. 4, in one possible form of embodiment where a node is fitted with more than one emitting device. For the purposes of illustration the diagram assumes that two light emitting devices are fitted, but it may be seen that the principle applies to any number of such devices greater than one.

In the graph in FIG. 4 the current draw 1 is indicated when both lights are illuminated simultaneously, and therefore the current drawn during this time is the sum of the current drawn by each device 3, causing a peak load on the power supply 4 that may be difficult to attain for reasons of economy or size. For example, the internal resistance of a battery or capacitor (which may also be used for energy storage) is often dependent on its physical size. The internal resistance of such battery or capacitor is an inherent and unavoidable property of such devices. At times of high current draw, those skilled in the art will know that the voltage across the battery or capacitor terminals will drop as a consequence of its internal resistance. Such a drop in voltage may disrupt the operation of the node controller electronics which requires a certain minimum voltage to operate correctly. In the graph in FIG. 4, the voltage available to the system 2 is shown dropping below a minimum requirement 4, resulting in system failure.

Figure 5:
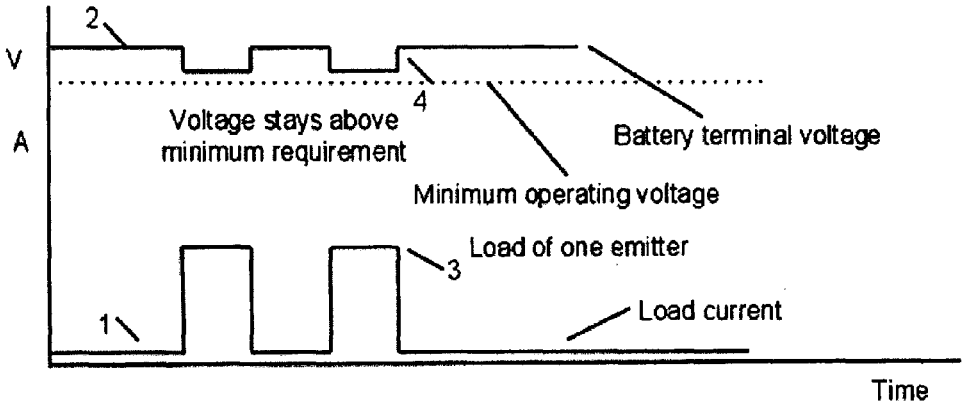
FIG. 5 illustrates a method to alleviate peak current draw and reduce excessive voltage drop.

In one possible embodiment of the invention where the node fires its strobes sequentially, FIG. 5 indicates the current 1 and voltage 2 in the system, where the lights are shown illuminating in sequence so that the peak current 3 at no time is high enough to make the voltage fall below that needed for correct operation 4. To those skilled in the art it will be understood that this method is concerned with limiting the maximum current at any one time by sequencing the loads, but that the exact number and combinations of loads, and the exact sequence of the pattern is not important.

In embodiments a node may take the physical form of a small, domed disc-like device including one or more sensors, in particular an acoustic sensor and/or a small digital passive infra-red sensor to act as a trigger. A small motor with folding flat impellers is provided on the top of the device and this is activated on detection of an intruder. A small motor was easily able to lift over 100 grams to a height of more than 20 meters, using the coanda effect over the body of the sensor which, in embodiments, was a surface a little over 40 mm in diameter (although a smaller surface, for example down to 20 mm diameter, could be employed).

In embodiments a node includes a small microphone and the processor is configured to filter the acoustic signal to selectively detect digging or other ground disturbance, looking for characteristic frequencies and/or patterns in the acoustic signal. Surround an area of ground to be protected from an intruder attempting to conceal an unwanted device in a protected area of ground.

In embodiments a node may include a mechanism to spray a detected intruder with a fluorescent material, for example nanodots, or die (colour) particles or the like. This facilitates identification of an intruder at a later date, for example by illumination with light on appropriate wavelength or a similar method. The labelling substance may be ejected from a pressurised micro bag and fire mechanism or from a piezoelectric spray head, or other mechanism. The spray mechanism may be activated by the intruder sensor detection circuit 2 and/or the tamper circuit 8. Preferably the sprayed material is chosen to be non-harmful to people, animal, insects and the environment.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. An intruder deterrent system, the system comprising:

at least one node having a curved or domed surface and comprising a Coanda-effect lifting system that comprises a motor-driven fan configured to direct air downwards over the curved or domed surface; and at least one strobe light, at least one of said nodes having an intruder-detecting sensor, wherein the system is configured to flash said at least one strobe light and to lift said node off the ground via the Coanda effect lifting system on detection of an intruder by said sensor to deter said intruder.

2. An intruder deterrent system as claimed in claim 1 comprising a plurality of said nodes, at least one of said nodes having a said intruder-detecting sensor.

3. An intruder deterrent system as claimed in claim 1 wherein one or each said node has a said strobe light, and wherein the system is configured to flash at least one of said strobe lights on detection of an intruder by said sensor to deter said intruder.

4. An intruder deterrent system as claimed in claim 1, wherein a said node is portable and battery powered and has a wireless communications device to enable the device to communicate with one or more other nodes of the system.

5. An intruder deterrent system as claimed in claim 1 wherein a said node has at least two said strobe lights and is configured to flash said strobe lights in synchronism said that no more than one of said strobe lights flashes at a time.

6. An intruder deterrent system as claimed in claim 1 comprising a plurality of said nodes, at least one of said nodes having a said intruder-detecting sensor, wherein said nodes are configured to communicate with one another such that said strobe lights of a plurality of different said nodes flash in a coordinated pattern.

7. An intruder deterrent system as claimed in claim 1 having a plurality of said sensors distributed over a plurality of different said nodes, wherein said nodes are configured to communicate with one another such that said strobe lights of a plurality of different said nodes flash, and wherein operation of a said strobe is dependent on a spatial distance of the strobe from a said sensor detecting said intruder.

8. An intruder deterrent system as claimed in claim 1 wherein said system is responsive to a control unit for selective deactivation of all or a part of said system.

9. An intruder deterrent system as claimed in claim 1 further comprising a control computer in communication with said nodes to determine spatial location of said nodes and to provide a user interface responsive to said determination to indicate missing areas of coverage of said system.

10. An intruder deterrent system as claimed in claim 1 wherein a said node has a beacon mode to provide user feedback on one or more of: an operational status of the node or system; node location; and node or system coverage.

11. An intruder deterrent system as claimed in claim 1 wherein a said node includes an infra-red beam to locate the node and/or to illuminate an area of coverage of a sensor associated with the nodes.

12. An intruder deterrent system as claimed in claim 1 wherein a said node has a plurality of said strobes and a plurality of said sensors, distributed circumferentially to provide selective coverage of a range of azimuthal angles about the node.

13. An intruder deterrent system as claimed as in claim 12 wherein one or both of said sensors and said strobes are angled upwards.

14. An intruder deterrent system as claimed in claim 1 wherein a said node is mechanically configured to be self-righting.

15. An intruder deterrent system as claimed in claim 1 wherein a said node further comprises means to physically tag a detected intruder for later identification.

16. An intruder deterrent system as claimed in claim 15 wherein said means to physically tag said detected intruder comprises means to spray said intruder with fluorescent material.

17. An intruder deterrent system as claimed in claim 1 wherein at least one said intruder-detecting sensor comprises an acoustic sensor.

18. An intruder deterrent system as claimed in claim 17 wherein a said node having a said acoustic sensor is configured to selectively detect an acoustic signal indicative of digging or similar ground disturbance to detect said intruder.

19. An intruder detection deterrent system as claimed in claim 1 comprising a set of said nodes, each said node being configured as an intruder detection node, each said node comprising a physical housing for deployment by placing on the ground, a battery powered microprocessor, wireless communications system for communicating with other nodes and/or a base station, and an alerting system for providing an overt or covert alert, such that the nodes of the system are deployable by dispersing over an area of ground to protect said area of ground from intruders.

20. A method of protecting an area of ground from intruders, the method comprising:

providing a system as recited in claim 1;

deploying a plurality of said nodes over the surface of said area of ground such that said nodes are in wireless communication with one another and/or a base station;

detecting an overt or covert alert from one or more of said nodes to detect a potential said intruder.

21. A method of deploying nodes of an intruder deterrent system as claimed in claim 1, the method comprising dropping said nodes or ballistically projecting said nodes over a range of spatially distributed locations.

* * * * *